US005346215A

United States Patent [19]

Asch

[11] Patent Number: 5,346,215

[45] Date of Patent: Sep. 13, 1994

[54] THREE-DIMENSIONAL PUZZLE

[76] Inventor: Sabine Asch, Heilbronner Strasse 100, 7120 Bietigheim-Bissingen, Fed. Rep. of Germany

[21] Appl. No.: 975,535

[22] PCT Filed: Aug. 24, 1991

[86] PCT No.: PCT/EP91/01614

§ 371 Date: Feb. 18, 1993

§ 102(e) Date: Feb. 18, 1993

[87] PCT Pub. No.: WO92/03199

PCT Pub. Date: Mar. 5, 1992

[30] Foreign Application Priority Data

Aug. 28, 1990 [DE] Fed. Rep. of Germany ... 9012335[U]

[51] Int. Cl.[5] ..... A63F 9/12

[52] U.S. Cl. ..... 273/155; 273/153 R

[58] Field of Search ..... 273/153 R, 155, 156, 273/153 P, 157 R; 446/487

[56] References Cited

U.S. PATENT DOCUMENTS

| | | | |
|---|---|---|---|
| 1,050,141 | 1/1913 | Joy | 273/156 |
| 1,565,901 | 12/1925 | Brandt | 273/153 P |
| 1,997,022 | 4/1935 | Stalker | 273/155 |
| 3,800,442 | 4/1974 | Petrocelli | 446/487 |
| 4,437,668 | 3/1984 | Simpson et al. | 273/156 |
| 4,578,291 | 3/1986 | Miner | 446/487 |
| 5,108,100 | 4/1992 | Essebaggers et al. | 446/487 |

*Primary Examiner*—Vincent Millin
*Assistant Examiner*—Steven B. Wong
*Attorney, Agent, or Firm*—Evenson, McKeown, Edwards & Lenahan

[57] ABSTRACT

A three-dimensional puzzle which consists of several mutually permanently connected puzzle bodies which result in a regular tetrahedron in the assembled state. All puzzle elements consist of truncated pyramids of different sizes which are disk-like. All puzzle elements are combined to a chain, in which each puzzle element is connected with the next-larger one along an edge in such a manner that they can be folded about these edges with respect to one another. In this chain, the individual puzzle elements are arranged such that they form a band which winds helically about an imaginary vertical center axis.

13 Claims, 2 Drawing Sheets

THREE-DIMENSIONAL PUZZLE

BACKGROUND AND SUMMARY OF THE INVENTION

The invention is a three-dimensional puzzle game for adults and children which results in a regular tetrahedron in the assembled state. It is used for entertainment and for demonstrating a specific geometrical principle.

The main game value of known puzzles is the achieving of the more or less tricky task of creating an order out of disorder. The disassembling or mixing-up does not have any special appeal. This has the disadvantage that the interest in the puzzle will wane as soon as it is determined how it can be assembled correctly and can be solved.

The tetrahedron puzzles known from U.S. Patent Documents U.S. Pat. Nos. 3,565,442 and 4,323,245 as well as the tetrahedron puzzle known from German Design Patent G 88 08 167.2 also have this disadvantage. In the case of the latter, this disadvantage is compensated by the fact that it can also be used for various purposes that are not game-related.

Another disadvantage of the known puzzles is that, even when they have a regular design, not much attention is paid to the geometrical principles on which the puzzles are based because the "pile of rubble" of the individual pieces stimulates thoughts on how the destroyed whole can be restored and not on according to which principle the individual pieces were shaped.

In addition, familiarity alone is a disadvantage in the case of puzzle games, and there is always a demand for novel puzzles.

It is the object of the invention to provide a three-dimensional puzzle game which is surprising in its unfamiliar pattern and creates special interest. The puzzle is to be entertaining not only when it is assembled but also when it is disassembled. For this purpose, the special characteristic of the tetrahedron is to be demonstrated impressively which is that it can be divided by means of a plane cut into a "tetrahedron disk" and into a new tetrahedron.

Other objects, advantages and novel features of the present invention will become apparent from the following detailed description of the invention when considered in conjunction with the accompanying drawings.

DETAILED DESCRIPTION OF THE DRAWINGS

Figure 1:
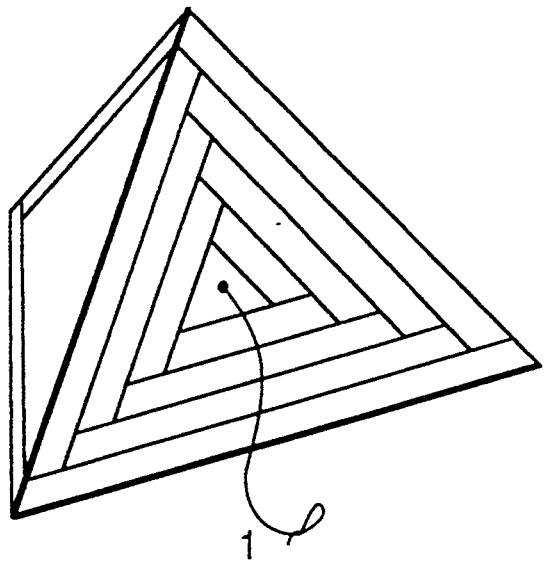
FIG. 1 is a view of an assembled puzzle.

FIG. 1 illustrates an assembled puzzle. It is a filled-in regular tetrahedron. On one surface, all puzzle elements are visible; on the second one, the largest three; on the third one, the largest two; and on the fourth one, only the largest element. Of the four surfaces, only the first two are visible in the drawing.

When the puzzle is held on the smallest element and is pulled upwards, it unfolds into a chain of adhering elements which has the appearance of a band which winds helically about an imaginary vertical center axis and becomes continuously wider in the downward direction. When this structure is placed on a plane base, the elements are grouped such that they create the appearance of a snail shell with a five-cornered base. A knocking-against this shape causes it to spread out more flatly into a structure of the type of a hexagon, as illustrated in a top view in FIG. 2.

The game consists of several puzzle bodies of different sizes which are all permanently connected with one another. All elements, with the exception of the smallest one, are truncated pieces of a regular tetrahedron, as created by means of a flat cut in parallel to one of its surfaces. The smallest element is itself a regular tetrahedron.

Figure 3A:
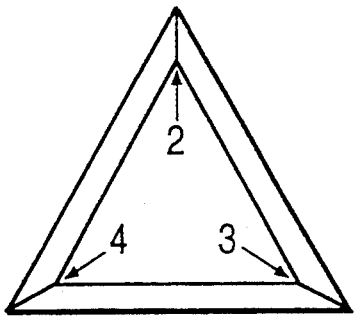
FIGS. 3*a* and 3*b* are views of two individual puzzle bodies for the demonstration of the size relationships between all elements.
Figure 3B:
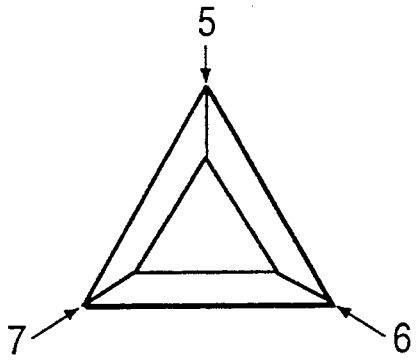

FIGS. 3*a* and 3*b* are top views of two individual puzzle elements and illustrate the size relationships between all elements: the smaller base triangle 2–3–4 of each truncated tetrahedron piece is identical to the larger base triangle 5–6–7 of the next smaller truncated tetrahedron piece. Correspondingly, the smaller base triangle of the smallest truncated tetrahedron piece is identical to a surface triangle of the smallest tetrahedron-shaped puzzle element.

Each element is connected with the next-larger and next-smaller element along one of its respective edges. In each case, two equally long chains are connected with one another. The connecting edges of the two individually shown elements in FIGS. 3*a* and 3*b* are, for example, the edge 2–3 of the larger and 5–7 of the smaller element. The connected edges abut directly with one another along their whole length. The connection is flexible so that the parts can be folded with respect to one another about the axis of the connected edges. The connection may be established by means of hinges, bands, threads or the like.

Figure 4:
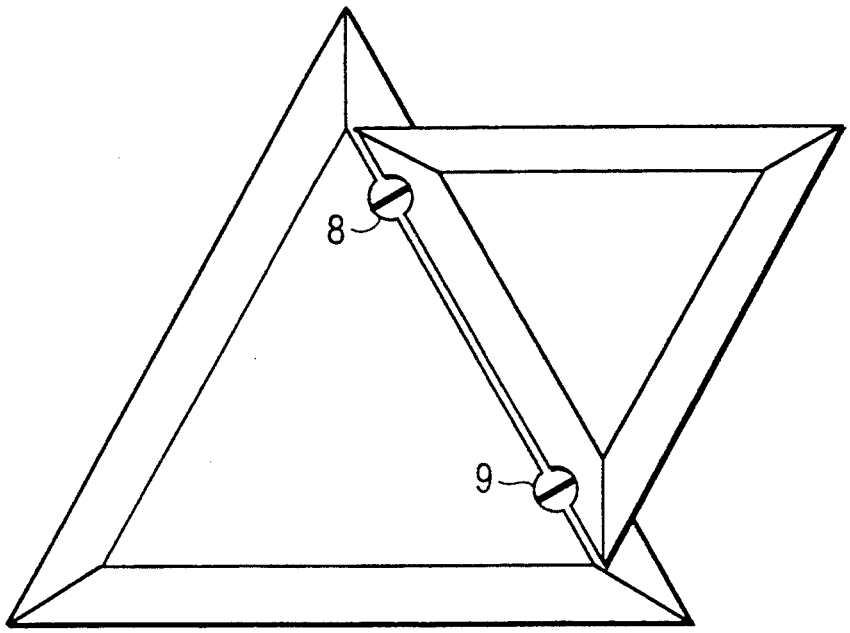
FIG. 4 is a view of the connection of the puzzle bodies on the example of two connected elements.

As an example, FIG. 4 is a top view of two connected puzzle pieces. The edges of the two pieces are connected with one another at two points by means of threads 8 and 9. The threads are fastened in the interior of the puzzle bodies or are pulled through to the next connecting point.

Figure 2:
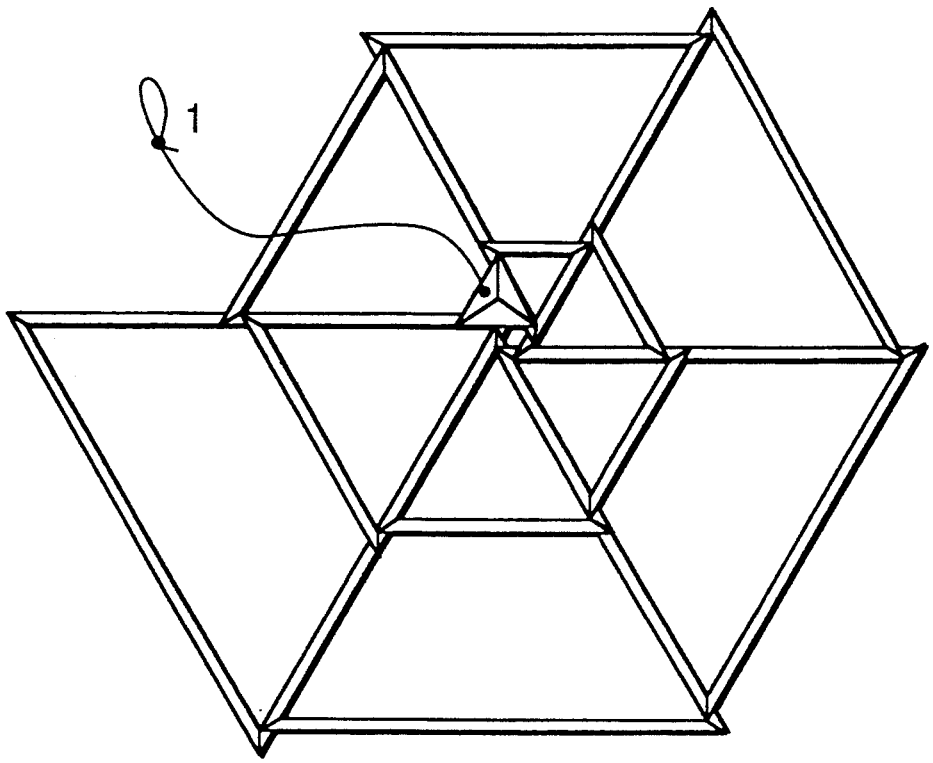
FIG. 2 is a top view of a disassembled puzzle.

The arrangement of all elements in the chain is illustrated in FIG. 2: If it is assumed that the truncated tetrahedron pieces are triangles, the apexes of all triangles, which are situated between the two edges connected with the adjacent elements, are disposed next to one another.

The height of the individual truncated tetrahedron parts and the number of elements in the puzzle chain determine the size of the assembled tetrahedron. The height must not necessarily be the same in the case of all elements. It may, for example, increase or decrease continuously from the smallest to the largest element.

The principle on which the game is based is demonstrated well starting from a number of twelve elements. The aesthetic attraction of the puzzle rises with an increasing number of puzzle elements.

In variant of the invention, the smallest tetrahedron-shaped puzzle element is left out. Instead, a gap remains in the assembled tetrahedron. This may be an advantage with respect to manufacturing techniques and appearance, particularly when the game is designed as a small object. The gap may also be used for accommodating an article, such as a piece of jewelry, or the like.

A further development provides a holding device which is mounted on the smallest puzzle element. In FIGS. 1 and 2, it is represented as a thread with a loop 1. This holding device facilitates the handling of the game. It may, for example, be a chain, a band, a ring or a thread and may also be constructed as a decorative element.

The puzzle game may be manufactured from firm materials, such as metal, plastic, plexiglass, wood or cardboard. The puzzle bodies may be solid or hollow. The visual effect of the game can be heightened by different materials, a coloring or a surface treatment of the individual elements or of their individual surfaces.

The special attraction of this game is the unexpected transformation of one shape into another orderly shape which is surprising. The joy in this transformation is long lasting even beyond the first surprise so that the puzzle continues to be enticing. The correct assembling method is usually not recognized immediately because the flat helically wound band seems to have nothing in common with the solid tetrahedron. Once the solution has been found, the puzzle can be assembled again rapidly and easily so that one does not hesitate to disassemble it again.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A three-dimensional puzzle including connected together puzzle elements, said puzzle elements including a plurality of truncated pyramids connected to one another in ascending size order to form a helical band which widens from top to bottom when in an unassembled condition and to form a tetrahedron when in an assembled condition.

2. A three-dimensional puzzle according to claim 1, wherein the truncated pyramid puzzle elements are obtained by a plane cut through a regular tetrahedron parallel to one of the surfaces of a regular tetrahedron.

3. A three-dimensional puzzle according to claim 2, wherein said puzzle elements are connected to one another along respective abutting edges so they can be folded about an axis along the abutting edges.

4. A three-dimensional puzzle according to claim 3, comprising a tetrahedron-shaped puzzle element connected to a smallest of the truncated pyramid puzzle elements, said tetrahedron-shaped puzzle element filling in an apex of the tetrahedron when in the assembled condition.

5. A three-dimensional puzzle according to claim 3, comprising a connecting device by which the puzzle can be held.

6. A three-dimensional puzzle according to claim 5, wherein said connecting device is connected to a smallest one of the puzzle elements.

7. A three-dimensional puzzle according to claim 1, wherein said puzzle elements are connected to one another along respective abutting edges so they can be folded about an axis along the abutting edges.

8. A three-dimensional puzzle according to claim 1, comprising a tetrahedron-shaped puzzle element connected to a smallest of the truncated pyramid puzzle elements, said tetrahedron-shaped puzzle element filling in an apex of the tetrahedron when in the assembled condition.

9. A three-dimensional puzzle according to claim 8, comprising a connecting device by which the puzzle can be held, said connecting device being connected to the tetrahedron-shaped puzzle element.

10. A three-dimensional puzzle according to claim 9, wherein the connecting device is one of a chain, a thread, and a ring.

11. A three-dimensional puzzle according to claim 1, comprising a connecting device by which the puzzle can be held.

12. A three-dimensional puzzle according to claim 11, wherein said connecting device is connected to a smallest one of the puzzle elements.

13. A three-dimensional puzzle according to claim 11, wherein the connecting device is one of a chain, a thread, and a ring.

* * * * *